United States Patent [19]

Tur et al.

[11] 3,967,700

[45] July 6, 1976

[54] SIGNALING SYSTEM

[75] Inventors: Charles J. Tur, Mequon; Donald J. Kopydlowski, Milwaukee, both of Wis.

[73] Assignee: Armor Elevator Company, Inc., Louisville, Ky.

[22] Filed: Aug. 5, 1974

[21] Appl. No.: 494,722

[52] U.S. Cl. ..... 187/29 R; 340/21

[51] Int. Cl.[2] ..... B66B 3/02

[58] Field of Search ..... 187/29; 340/21, 336

[56] References Cited

UNITED STATES PATENTS

| | | | |
|---|---|---|---|
| 3,414,088 | 12/1968 | Bruns et al. | 187/29 |
| 3,483,950 | 12/1969 | Simpson | 187/29 |
| 3,631,478 | 12/1971 | McNaney | 340/336 X |
| 3,636,553 | 1/1972 | Hancock | 340/336 |

*Primary Examiner*—Robert K. Schaefer
*Assistant Examiner*—W. E. Ducanson, Jr.
*Attorney, Agent, or Firm*—Andrus, Sceales, Starke & Sawall

[57] ABSTRACT

A floor position sensor monitors the movement of an elevator car and provides a first predetermined number of inputs each corresponding to a predetermined floor and connected to a first signal converting circuit providing a second predetermined number of coded outputs less than the first predetermined number in response to an input position signal appearing at one of the first inputs corresponding to the floor where the elevator car is located. Each position indicator is remotely located from the sensor and includes opto-isolating circuits connected to receive the second outputs and provides a third predetermined number of outputs photo-electrically isolated from and in response to the second outputs and connected to a second signal converting circuit providing a fourth predetermined number of coded outputs responsive to the third outputs. The fourth coded outputs are connected to an eight segment display and a nine segment display through driver circuits which selectively connect one or more of the display segments in circuit for energization to selectively display one or more alpha-numeric characters in response to the input position signal. An alternative embodiment provides a display employing script type characters utilizing ten elliptically shaped elongated segments to provide predetermined alpha-numeric characters.

28 Claims, 14 Drawing Figures

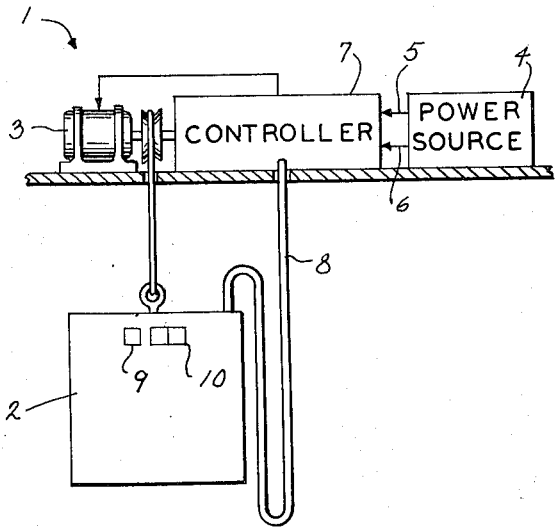
Fig. 1
Fig. 8
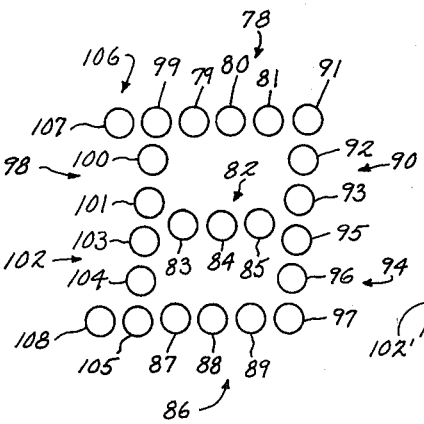
Fig. 9
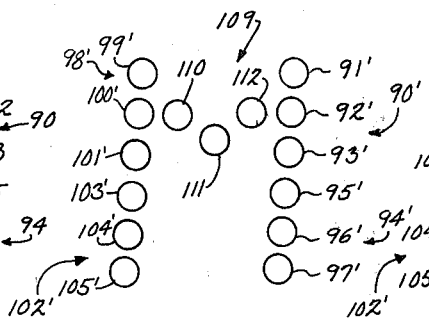
Fig. 10
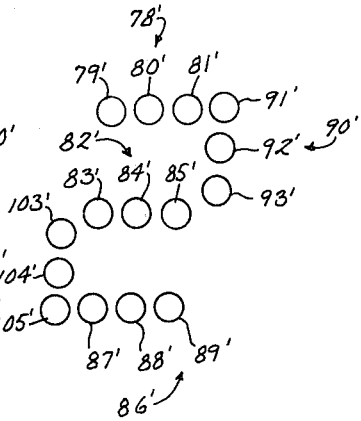
Fig. 11
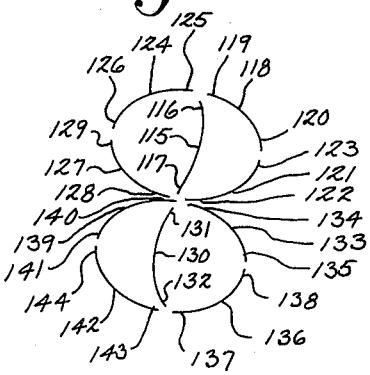
Fig. 12
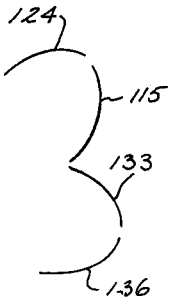
Fig. 13
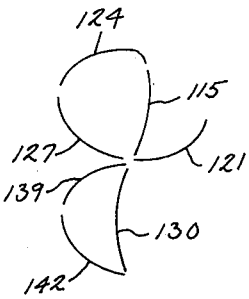
Fig. 14
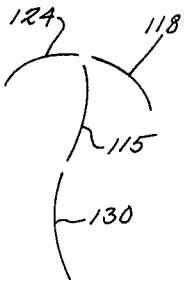

SIGNALING SYSTEM

BACKGROUND OF THE INVENTION

This invention relates to a signaling system providing a selected character display in response to the selective actuation of an input and is particularly desirable for use in an elevator system in which a remotely located position indicator selectively displays a position indicating character in response to the operation of a position sensor sensing the relative movement of an elevator car with respect to a plurality of floors.

Elevator car position displays have long been utilized to visually convey the relative position of an elevator car with respect to the floors or landings of which it serves to passengers riding within the car and in some cases to prospective passengers located at various floors or landings or to maintenance or supervisory personnel located at a central control station. Some position indicators located at floors or landings have responded to indicate the presence of the car at that particular landing only. Other types of position indicators utilized at landings and possibly within cars have included mechanical, semi-circular indicators having rotating arrow pointers to indicate the car's location by pointing to one of a plurality of semi-circular positioned numbers corresponding to the number of floors in the building.

Other elevator car position displays have selectively energized one of a predetermined number of lamps each corresponding to a particular floor and mounted to illuminate a numerical character displayed on a transparent mask or as jewels in a face plate and corresponding to such floor, such as illustrated in the U.S. Pat. No. 2,741,755 issued on Apr. 10, 1956. The use of such an indicator for an exceedingly tall building structure would necessarily require a quite large and cumbersome display panel.

Other types of elevator car position indicators have utilized a window through which position indicia located upon a rotating drum are successively exposed through operation of a notching or stepping motor, such as illustrated in the U.S. Pat. No. 3,103,645 issued on Sept. 10, 1963.

The utilization of incandescent or gaseous discharge lamps frequently pose a problem due to burn outs through repetitive use thereby requiring the elevator car to be put out of service for replacement of such lamps.

Light emitting diodes (LEDs) have been utilized within elevator position displays and arranged into display groups for selective energization to form certain alpha numeric characters having extreme brilliance and long operating life. One system has proposed the utilization of one or more of the standard seven segment or figure eight segmented displays which are capable of providing the numerals 0 through 9 inclusive, and several alpha characters such as L for the lobby designation, P for the pool or penthouse designation, or C for the cafeteria designation, for example. Such an elevator position indicating system has further proposed another seven segment display utilizing light emitting diodes only with the figure eight configuration tilted approximately 45° so that selected pairs of segments can be selectively energized to formulate up and down direction arrows. While such proposed systems have desirably been utilized to display certain alpha numeric characters, they have been unable to desirably display certain alpha characters which have been customarily utilized with past elevator systems for designating the basement and the mezzanine, namely the letters B and M.

One proposed conventional seven segment light emitting diode display utilizes a five-deck make-before-break stepper switch possible utilized with a signal converter to supply a coded signal through a traveling cable leading to an elevator car or through a fixed cable leading to a landing. Such cables in the proposed system may consist of five control leads, one common lead and one blank lead (such as for indicating a not-in-service condition) for supplying control signals to the position display unit to control the energization of two distinct character LED displays. Such coupling cables in turn, have been connected to the two conventional seven segment LED displays through a diode coupling matrix utilized to selectively energize the LED segments. Such an arrangement, however, is extremely susceptible to transient conditions such as possibly occurring in response to the operation of the elevator car door when the car stops at a particular landing. Such transient or noise signals can cause a malfunction within the position LED display and can destroy or damage the diode matrix circuit or other associated LED driving circuitry to thereby render the entire position indicating system inoperative and in need of repair.

Other types of position indicating systems for elevators have employed a single array or group consisting of rows and columns of light emitting diodes with each diode selectively controlled by a discrete diode matrix for selectively energizing each diode independently of other surrounding diodes. Some such systems have employed an oscillatory scanning sequence which sequentially scans all pre-programmed alpha numeric characters while control signals supplied through the coupling cable stop the scan at the appropriate desired character to illuminate certain LEDs on an individual basis to formulate the required display. While such systems employing arrays of individually energized LEDs have been operably utilized, some have not produced the desired highly distinctive character features due to a failure to provide a proper illuminating correlation with adjacent illuminated diodes for certain characters.

SUMMARY OF THE INVENTION

This invention relates to a signaling system providing a selected character display in response to the selective actuation of an input and is particularly desirable for use in an elevator system in which a remotely located position indicator selectively displays a position indicating character in response to the operation of a position sensor sensing the relative movement of an elevator car with respect to a plurality of floors.

In one form of the invention, a highly novel character display is provided which includes seven elongated segments arranged to be selectively energized in response to the operation of an input means to form numerical characters selected from the numbers 0–9 inclusive, and further employs an eighth segment located in combination with one or more of the other seven segments so that the entire eight segment grouping is selectively energized in response to an operation of the input means to form an alpha character selected from a plurality of alpha characters including the letter B. In another form of the invention, another segment is employed with the seven elongated segments so that the entire eight segment grouping is selectively energized in response to an operation of the input means to form an alpha character selected from a plurality of alpha characters including the letter M. A highly desirable display is thus provided for displaying alpha numeric characters representing the selective actuation of an input, such as provided by the sensed position of an elevator car for example, in a highly illuminated manner which is further capable of distinctly displaying the letters B, such as to indicate a basement floor for example, and the letter M, such as to indicate a mezzanine floor for example.

In one preferred form of the invention, the display includes first, second and third substantially horizontal segments vertically spaced with respect to each other and each including first and second end portions. A fourth substantially vertical segment is located adjacent to the second ends of the first and second segments while a fifth substantially vertical segment is located adjacent to the second ends of the second and third segments. A sixth substantially vertical segment is located adjacent to the first ends of the first and second segments while a seventh substantially vertical segment is located adjacent to the first ends of the second and third segments. A highly novel eighth segment includes first and second portions with the first portion being located adjacent to and in substantial horizontal alignment with the first end of the first segment and is also located adjacent to the sixth segment while the second portion is located adjacent to and in substantial horizontal alignment with the first end of the first segment and is also located adjacent to the seventh segment. The input means is selectively operated to selectively energize one or more of the segments and display a character selected from a plurality of characters including the numbers 0–9 inclusive and the letter B, such as for indicating the position of an elevator car for example. In one form of the invention, the input means is selectively operated by elevator car position sensing means provided by an elevator control means.

In another preferred form of the invention, the first through the seventh segments inclusive are located as described above while an eighth V-shaped segment provides first and second upper end portions and an intermediate portion with the first portion located adjacent to the sixth segment and the second portion located adjacent to the fourth segment. The input means is selectively operated to selectively energize one or more of the segments and display a character selected from a plurality of characters including the numbers 0–9 inclusive, and the letter M, such as for indicating the position of an elevator car for example.

In another aspect of the preferred embodiment, a nine segment display is provided including the first through seventh segments inclusive as above described together with an eighth segment utilized to form the letter B and a ninth segment utilized to form the letter M in a highly novel and versatile manner.

The segments employed in the preferred embodiment include a plurality of light emitting diodes so that all diodes within a given segment are uniformly energized to display a clear and distinct line forming either the whole or a portion of an indicative character. The employment of uniformly energized groups of light emitting diodes formed into segments provides a plurality of distinctive point sources of light energy which are always correlated with adjacent LEDs in the same segment for distinctive display through transparent or other light conducting masks or the like for good visability at great distances. The first through seventh segments as defined above each includes a plurality of three light emitting diodes which are serially connected for uniform energization while the additional segment employed in displaying the letter B includes two spaced and serially connected light emitting diodes and the additional segment employed in displaying the letter M includes three V-shaped serially connected light emitting diodes.

In another important aspect of the invention, the character display of the indicating apparatus is electrically isolated from the signals transmitted from the input means by a light sensitive circuit isolating means. In this regard, coupling means electrically connects the input means to the indicating means to provide a first plurality of control signals in response to the operation of the input means. The indicating means, in turn, includes converting means connected to operatively receive the first control signals and provide a second plurality of control signals which are electrically isolated from and related to the first plurality of signals. The display means which includes a plurality of light emitting means is operatively connected to the converting means to be selectively energized in response to the second plurality of isolated signals to display the selected character.

A highly desirable and novel opto-isolating circuitry is provided within the converting means which prevents extraneous transient and other noise signals from providing a malfunction to the display and further prevents damage from such transient signals to the signal driving and indicating equipment. Such an isolating circuitry is connected to receive a first reference signal through the coupling means relating to the reference potential of the input means and operates, in turn, to provide a second reference signal which is isolated from the first reference signal and establishes an isolated reference potential for the plurality of display segments.

In a preferred form of the invention, the input means is remotely located from the display and is shown in the preferred embodiment as an elevator car position sensor which is commonly found in the penthouse machine room. The input means provides a first predetermined number of inputs each corresponding to a specified input, such as a predetermined floor in an elevator system. The first predetermined inputs are connected to a first signal converting means which may also be conveniently located in the same location as the input means, such as in the penthouse machine room of an elevator system for example, to provide a second predetermined number of coded outputs less than the first predetermined number in response to an input signal appearing at one of the first inputs. Such an input signal corresponds to the floor where a car is located in an elevator position sensing system. The indicating means includes the opto-isolating circuit means connected to the second outputs such as through a cable and operates to provide a third predetermined number of outputs in response to and electrically isolated from the second outputs. The third outputs, in turn, are connected to a second signal converting means providing a fourth predetermined number of coded outputs responsive to the third outputs. The fourth outputs, in turn, are connected to the multiple segment display through driver circuits which operatively connect one or more of the segments in circuit for energization to selectively display a character in response to the input signal.

A highly desirable alternative display is also provided which utilizes a plurality of elongated segments arranged to be selectively energized in response to the operation of the input means. Such alternative display operates to selectively form predetermined script type alpha numeric characters in response to the operation of the input means. Each of the plurality of segments are elliptically formed and include a plurality of serially connected light emitting diodes. The alternative embodiment specifically employs ten elliptical segments which are arranged to form an upper section spaced above a lower section with each section including five segments. The upper and lower sections are similarly constructed with the upper section including four segments located to form an egg-shaped design with the fifth segment vertically disposed to dissect the egg-shaped design.

The highly desirable indicating system disclosed herein provides highly distinctive alpha numeric characters which are readily visible at great distances and which operate in response to remotely generated control signals in a highly reliable manner.

BRIEF DESCRIPTION OF THE DRAWINGS

The drawings furnished herewith illustrate the best mode presently contemplated by the inventors and clearly disclose the above advantages and features as well as others which will be readily understood from the detailed description thereof.

In the drawings:

FIG. 1 is a diagrammatic view of an elevator system illustrating a position indicating display located within an elevator car;

FIG. 8 is a diagrammatic illustration showing one possible mode of energization for the displays in FIGS. 6 or 7;

FIG. 9 is a diagrammatic illustration showing one possible mode of energization for the display of FIG. 7;

FIG. 10 is a diagrammatic illustration showing one possible mode of energization for the displays in FIGS. 6 or 7;

FIG. 11 is a diagrammatic illustration of an alternative embodiment utilizing a script type ten segment font for an elevator car positioning display;

FIG. 12 is a diagrammatic illustration showing one possible mode of energization for the font of FIG. 11;

FIG. 13 is a diagrammatic illustration showing another possible mode of energization for the font of FIG. 11; and FIG. 14 is a diagrammatic illustration showing another possible mode of energization for the font of FIG. 11.

DESCRIPTION OF THE PREFERRED ILLUSTRATED EMBODIMENT

Figure 2:
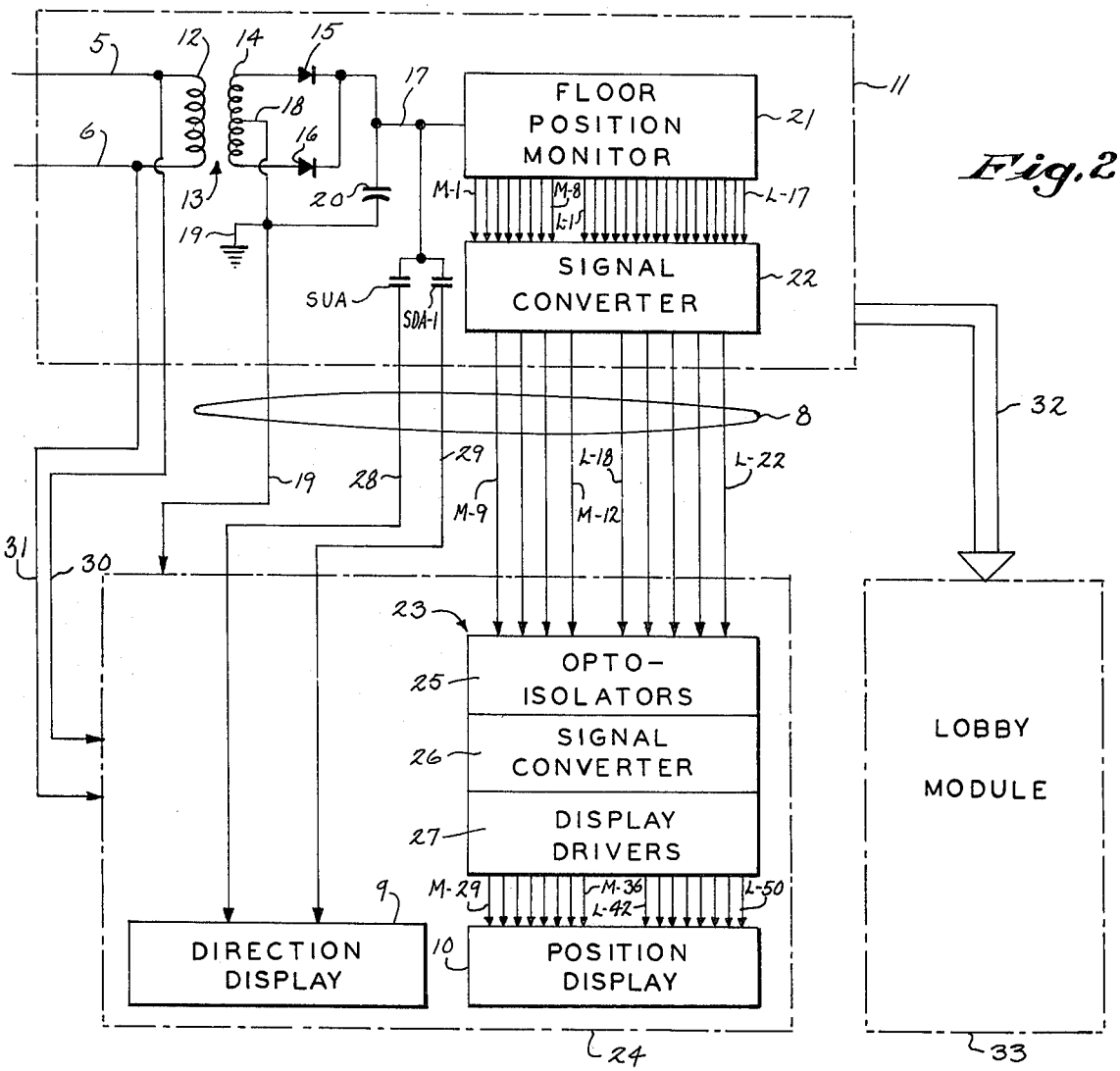
FIG. 2 is a circuit schematic including diagrammatical blocks illustrating a position indicating system for an elevator.

Referring to the drawings and particularly to FIG. 1, an elevator system 1 provides an elevator car 2 movably mounted for vertical travel within a structure (not shown) to serve a plurality of floors or landings. Specifically, the car 2 is vertically moved by the operation of a driving motor 3 which receives power from a power source 4 such as through the leads 5 and 6 and is controlled through an electrical control circuit designated generally as controller 7. The elevator controller 7 illustrated in FIG. 1 may utilize any type of control system for selectively moving the car 2 from floor to floor under either manual control by an operator within the car 2 or automatic control in response to service demand as registered by passengers within the car 2 and perspective passengers located at the plurality of landings. The controller 7 could, for example, utilize the elevator dispatching and control system as described in the U.S. Pat. No. 2,854,096 issued to K. M. White et al. on Sept. 30, 1958, and assigned to a common assignee herewith. A traveling cable 8 is connected to the controller 7 and to the car 2 for supplying coded signals to selectively energize a direction display 9 and a position display 10 as will be more fully described hereinafter.

With specific reference to FIG. 2, the controller 7 includes a control module 11 which may be located within a penthouse machine room or other desirable location and receives energizing power through the leads 5 and 6 as supplied from the source 4 which may include a 115 volt, 60 hertz A.C. supply input. Specifically, the alternating input at the leads 5 and 6 is coupled to a primary winding 12 of an input transformer 13 which, in turn, provides an output winding 14 connected through a pair of rectifying diodes 15 and 16 to provide a D.C. output at the output lead 17. The output transformer winding 14 is center tapped such as at 18 and connected to a machine room ground such as at 19 with a capacitor 20 coupled between the D.C. output lead 17 and the ground lead 19.

The D.C. output lead 17 provides energizing power to a floor position monitor 21 which may take the form of any one of a number of car position sensors. One type of position sensor which could be used for the monitor 21 includes a brush carriage which is driven by the motor 3 through its output shaft in direct response to the vertical movement of the car 2. The selective movement of such a brush carriage assembly in response to the vertical car movement selectively connects the D.C. potential at input lead 17 to one or more of a plurality of position indicating leads designated M-1 through M-8, inclusive, and L-1 through L-17, inclusive, to selectively supply car position signals to a signal converter 22. Each of the 25 input leads connecting the car position monitor 21 and the signal converter 22 represents a predetermined character which by itself or in combination with other characters represents a designated position of the elevator car 2. Specifically, each of the eight leads designated M-1 through M-8 controls a predetermined alpha or numeric character to be displayed as a most significant or left hand character while each of the seventeen leads designated L-1 through L-17 controls a predetermined alpha or numeric character to be displayed as a least significant or right hand character.

The signal converter 22 receives the input signals supplied through the leads M-1 through M-8 and L-1 through L-17 and provides a coded output through the four leads designated M-9 through M-12, inclusive, and the five leads designated L-18 through L-22, inclusive, to an isolating, converting and driving assembly 23 within a vehicle module 24 located within the car 2. The isolating, converting and driving assembly 23 includes an opto-isolator circuit 25 which is connected to receive the coded output supplied through the leads M-9 through M-12 and L-18 through L-22, inclusive, and operates, in turn, to supply an isolated output to a signal converter 26. The signal converter 26, in turn, operates through a display driver 27 to energize the position display 10 through a plurality of output leads designated M-29 through M-36, inclusive, and L-42 through L-50, inclusive. It shall be noted that all leads having a designation containing the prefix M relate to and control the operation of the most significant or left hand character while the leads having a designation containing the prefix L relate to and control the operation of the least significant or right hand character.

The D.C. voltage lead 17 is selectively connected to an up direction signal lead 28 through the normally open contacts SUA-1 of the up direction relay and to a down direction signal lead 29 through the normally open contacts SDA-1 to provide selective illumination or energization of direction arrows located within the direction display 9. The machine room ground lead 19 is also connected to supply an input to the vehicle module 24 while the A.C. input leads 5 and 6 are coupled through the leads 30 and 31, respectively, to provide operating power to the vehicle module 24.

The four signal leads designated M-9 through M-12, the five signal leads designated L-18 through L-22, the ground lead 19, and the direction signal leads 28 and 29 are preferably included within the traveling cable 8 while the A.C. power leads 30 and 31 may be coupled to a plurality of contacts adapted to selectively engage sliding contacts mounted on the car 2 for supplying power thereto. A plurality of leads similar to those within cable 8 may also be parallel connected to the outputs supplied from the control module 11 and included within a fixed cable such as illustrated at 32 to supply identical signals to a lobby module 33 or to other fixed displays located at other floors or elsewhere. The module 33 is constructed in a similar manner as the vehicle module 24 and further discussion thereof is deemed unnecessary.

Figure 3:
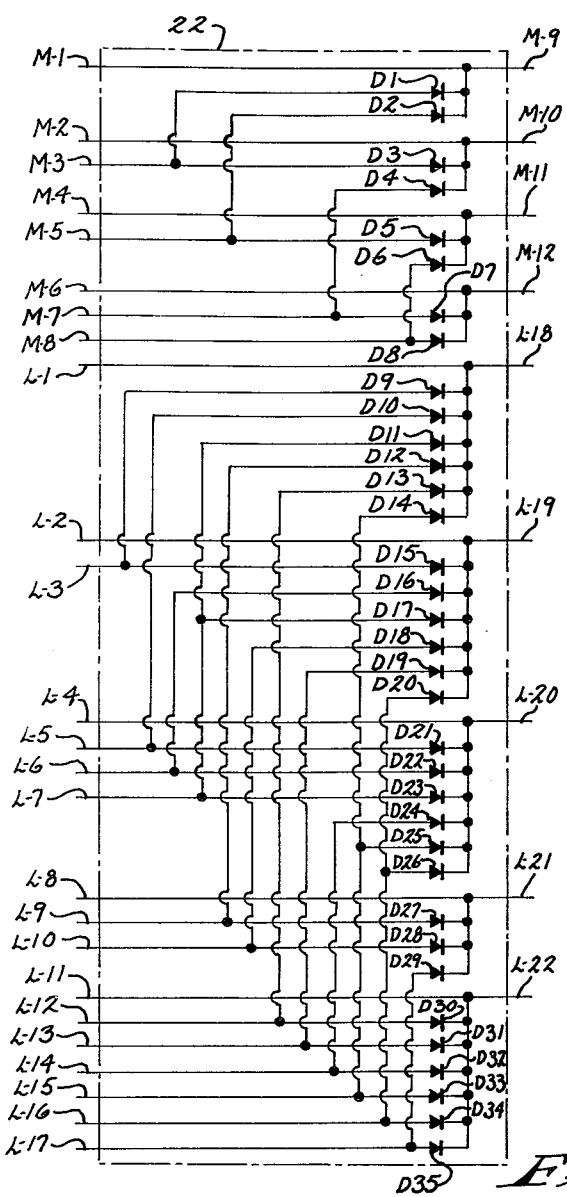
FIG. 3 is a circuit schematic showing a signal converter located in the control module shown in FIG. 2.

The signal converter 22 is illustrated in FIG. 3 in which the input leads designated M-1 through M-8, inclusive, are connected either directly or through a plurality of diodes designated D-1 through D-8, inclusive, to certain of the output leads designated M-9 through M-12, inclusive. In addition, the input leads designated L-1 through L-17, inclusive, are connected either directly or through a plurality of diodes designated D-9 through D-35, inclusive, certain of the output leads designated L-18 through L-22, inclusive.

Figure 6:
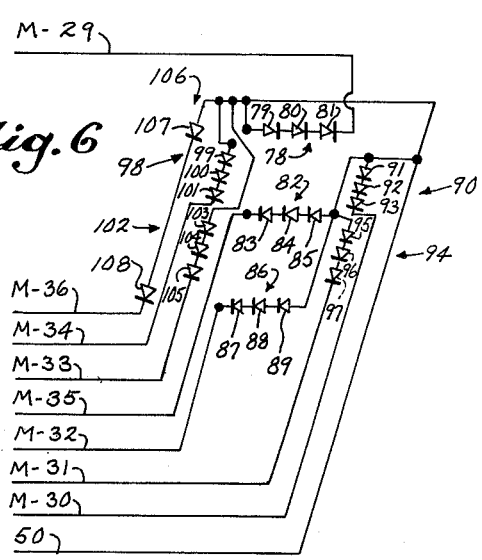
FIG. 6 is a circuit schematic of the most significant or left character display having eight segments within the position display shown in FIGS. 1 and 2.
Figure 7:
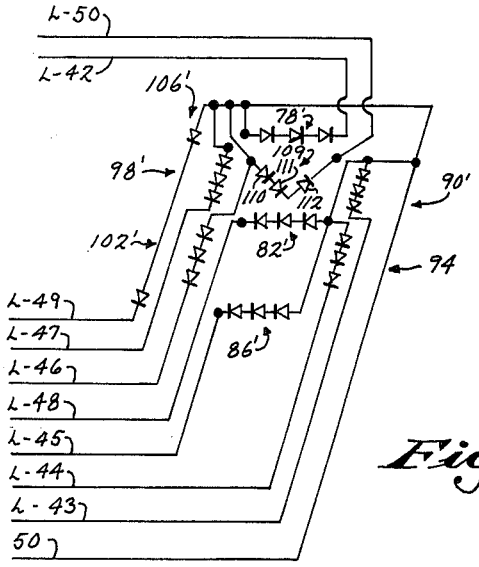
FIG. 7 is a circuit schematic illustrating the least significant or right character display having nine segments within the position display shown in FIGS. 1 and 2.

In operation, the floor position monitor 21 selectively supplies energization to one of the input leads L-1 through L-17 and possibly to one of the input leads M-1 through M-8 to thereby selectively energize a two character display as illustrated in FIGS. 6 and 7. As illustrative examples, the positive D.C. input at lead 17 is selectively connected to energize the input lead M-1 for displaying a tens decimal digit 1 to provide an output signal at the lead M-9. In like manner, the energization of the lead M-2 for displaying a tens decimal digit 2 provides an output signal at the lead M-10. The energization of the lead M-3 for displaying a tens decimal digit 3 provides an output signal at the lead M-9 supplied through the diode D-1 and an output signal at the lead M-10 supplied through the diode D-3. The energization of the input lead M-4 for displaying a tens decimal digit 4 provides an output signal at the lead M-16 supplied The energization of the input lead M-5 for displaying a tens decimal digit 5 provides an output signal at the lead M-9 supplied through the diode D-2 and an output signal at the lead M-11 supplied through the diode D-5. The energization of the lead M-6 for displaying a letter B provides an output signal at the lead M-12. The energization of the lead M-7 for displaying a letter G provides an output signal at the lead M-10 supplied through the diode D-4 and an output signal at the lead M-12 supplied through the diode D-7. The energization of the lead M-8 for displaying a letter L provides an output signal at the lead M-11 supplied through the diode D-6 and an output signal at the lead M-12 supplied through the diode D-8.

In like manner, the energization of the lead L-1 for displaying a units decimal digit 1 provides an output signal at the lead L-18. The energization of the lead L-2 for displaying a units decimal digit 2 provides an output signal at the lead L-19. The energization of the lead L-3 for displaying a units decimal digit 3 provides an output signal at the lead L-18 supplied through the diode D-9 and an output signal at the lead L-19 supplied through the diode D-15. The energization of the lead L-4 for displaying a units decimal digit 4 provides an output signal at the lead L-20. The energization of the lead L-5 for displaying a units decimal digit 5 provides an output signal at the lead L-18 supplied through the diode D-10 and an output signal at the lead L-20 supplied through the diode D-21. The energization of the lead L-6 for displaying a units decimal digit 6 provides an output signal at the lead L-19 supplied through the diode D-16 and an output signal at the lead L-20 supplied through the diode D-22. The energization of the lead L-7 for displaying a units decimal digit 7 provides an output signal at the lead L-18 supplied through the diode D-11, an output signal at the lead L-19 supplied through the diode D-17 and an output signal at the lead L-20 supplied through the diode D-23. The energization of the lead L-8 for displaying a units decimal digit 8 provides an output signal at the lead L-21. The energization of the lead L-9 for displaying a units decimal digit 9 provides an output signal at the lead L-18 supplied through the diode D-12 and an output signal at the lead L-21 supplied through the diode D-27. The energization of the lead L-10 for displaying a units decimal digit 0 provides an output signal at the lead L-19 supplied through the diode D-18 and an output signal at the lead L-21 supplied through the diode D-28. The energization of the lead L-11 for displaying a letter B provides an output signal at the lead L-22. The energization of the lead L-12 for displaying a letter P provides an output signal at the lead L-18 supplied through the diode D-13 and an output signal at the lead L-22 supplied through the diode D-30. The energization of the lead L-13 for displaying a letter G provides an output signal at the lead L-19 supplied through the diode D-19 and an output signal at the lead L-22 supplied through the diode D-31. The energization of the lead L-14 for displaying a letter L provides an output signal at the lead L-20 supplied through the diode D-24 and an output signal at the lead L-22 supplied through the diode D-32. The energization of the lead L-15 for displaying the letter S provides an output signal at the lead L-18 supplied through the diode D-14, an output signal at the lead L-20 supplied through the diode D-25 and an output signal at the lead L-22 supplied through the diode D-33. The energization of the lead L-16 for displaying a letter M provides an output signal at the lead L-19 supplied through the diode D-20, an output signal at the lead L-20 supplied through the diode D-26, and an output signal at the lead L-22 supplied through the diode D-34. The energization of the lead L-17 for displaying a letter A provides an output signal at the lead L-21 supplied through the diode D-29 and an output signal at the L-22 supplied through the diode D-35.

The selective energization of one of the inputs M-1 through M-8 and one of the inputs L-1 through L-17 within the signal converter 22 provides a two character display capable of presenting a wide variety of combinations of letters and numbers. For example, the energization of the leads M-6 and L-2 would display the designation B2 to designate the location of the car at the second basement floor. The energization of the leads M-5 and L-9 would display the designation 59 to designate the location of the car at the fifty-ninth floor. The various numbers can thus represent the various floor levels while the letter B can designate the basement, the letter P can designate the penthouse, parking or pool, the letter G can designate the garage or ground level, the letter L can designate the lobby, the letter S can designate the street or sub-level, the letter M can designate the mezzanine, and the letter A can designate the annex, for example. It is understood that other appropriate designations can be represented by such letters for use in an elevator system.

Figure 4:
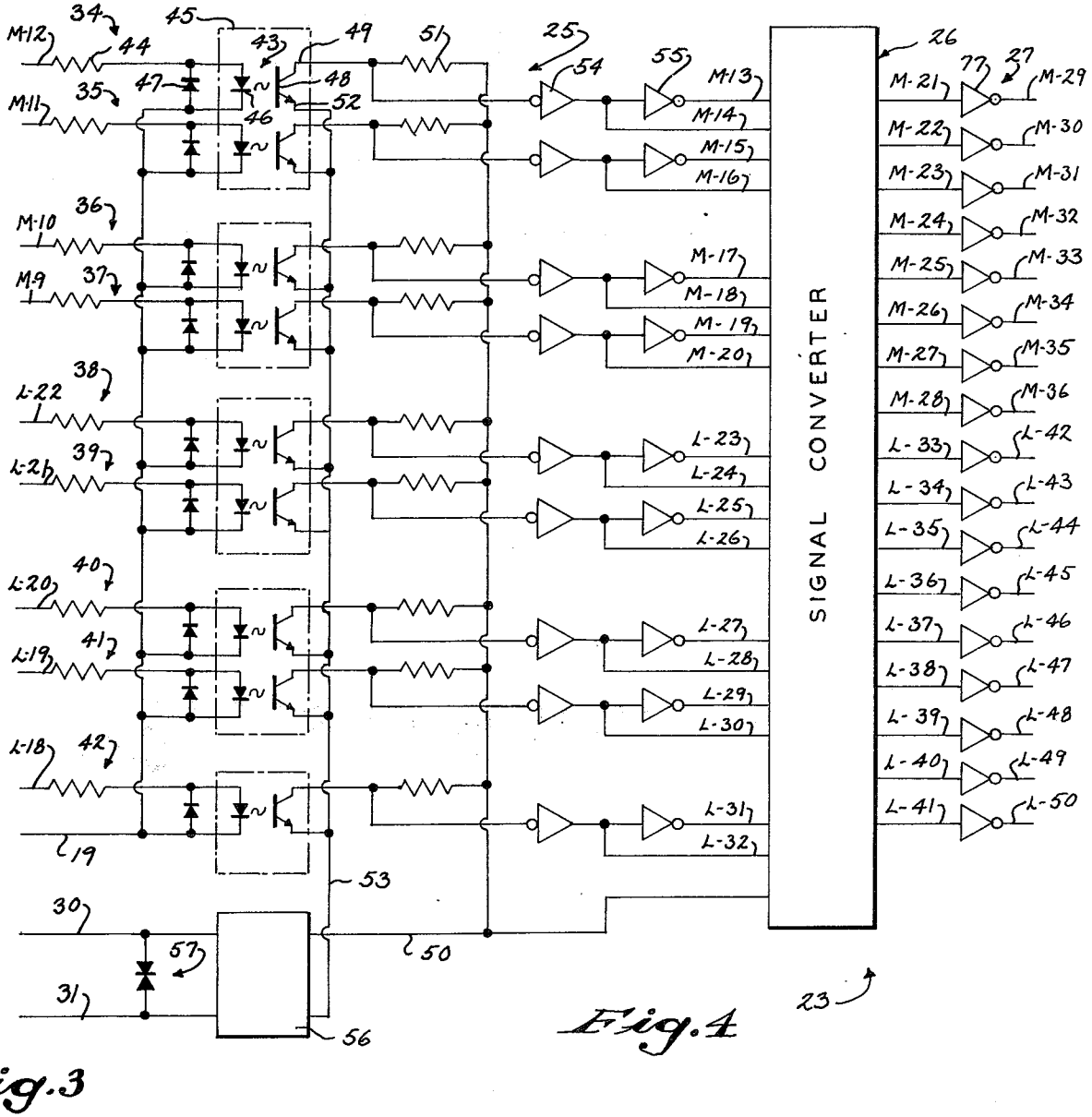
FIG. 4 is a circuit schematic illustrating certain elements within the display module shown in FIG. 2.

The isolating, converting and driving circuity 23 is illustrated in FIG. 4 and includes the opto-isolator 25, the signal converter 26 and the display drivers 27.

The output leads M-9 through M-12 and L-18 through L-22 supplied from the signal converter 22 through the cable 8 are connected to the opto-isolator 25 which provides a plurality of channels for supplying a pair of outputs corresponding to each designated input. Specifically, an input appearing at the lead M-12 is supplied to a channel 34 for providing a pair of corresponding outputs at the leads M-13 and M-14. An input appearing at the lead M-11 is supplied to a channel 35 for providing a pair of outputs at the leads M-15 and M-16. An input appearing at the lead M-10 is supplied to a channel 36 for providing a pair of outputs at the leads M-17 and M-18. A signal appearing at the lead M-9 is supplied to a channel 37 for providing a pair of outputs at the leads M-19 and M-20. An input appearing at the lead L-22 is supplied to a channel 38 for providing a pair of outputs at the leads L-23 and L-24. A signal appearing at the lead L-21 is supplied to a channel 39 for providing a pair of signals to the output leads L-25 and L-26. A signal appearing at the lead L-20 is supplied to a channel 40 for providing a pair of outputs at the leads L-27 and L-28. An input appearing at the lead L-19 is supplied to a channel 41 for providing a pair of outputs at the leads L-29 and L-30. An input appearing at the lead L-18 is supplied to a channel 42 for providing a pair of outputs to the leads L-31 and L-32.

The channels 34 through 42, inclusive, are similarly constructed so that only channel 34 will be described in detail. Specifically, the input lead M-12 is connected to a phototransistor opto-isolator 43 through a resistor 44. Such an opto-isolator 43 could constitute the phototransistor opto-isolators manufactured by Monsanto and designated MCT6 which was formerly designated MCT2-D which are marketed with two channels as indicated by the enclosure shown in phantom at 45. Each phototransistor includes a GaAsLITE emitting diode 46 which provides an anode circuit connected to the resistor 44 and a cathode circuit connected to the machine room ground potential lead 19. A protective diode 47 is parallel connected to the diode 46 and provides a cathode circuit connected to the resistor 44 and an anode circuit connected to the ground lead 19 for providing protection for the phototransistors 43 from abnormal transient conditions. The light emitting diode 46 generates infra-red light proportional to the current passing through the diode and resistor 44 in the forward direction while an output silicon phototransistor 48 detects and amplifies the photocurrent generated in its photosensitive base region. A collector circuit 49 of the phototransistor 48 is connected to a positive D.C. voltage source lead 50 through resistor 51 while an emitter circuit 52 is connected to a logic circuit ground potential lead 53.

The collector circuit 49 of the phototransistor 48 is also connected to supply an input to an inverting amplifier 54 which, in turn, supplies an output to the output lead M-14. The output of the inverting amplifier 54 is also connected as an input to an inverting amplifier 55 which, in turn, provides an output to the lead M-13. The leads 30 and 31 supplying the A.C. power from the machine room control module 11 to the vehicle module 24 are connected to a highly regulating power supply circuitry 56 shown in block diagrammatic form which may constitute any available power supply capable of providing a constant D.C. voltage output at the lead 50 and a logic system common or ground potential signal at the lead 53. The back to back and serially connected diodes 57 connected across the leads 30 and 31 protect the power supply circuitry 56 from abnormal transient signals or the like.

The opto-isolators 25 thus provides a highly desirable circuit isolating system for preventing noise or other transient signals from providing false control signals and possibly damaging the subsequent logic and display circuitry. Such isolation by the opto-isolators 25 converts the signal reference from a machine room ground as provided on the lead 19 to a logic circuit ground as provided on the lead 53. The opto-isolators 25 also convert the control signals appearing at leads M-9 through M-12 and L-18 through L-22 from a substantially high input voltage such as 18 volts D.C., for example, to a substantially lower output voltage such as less than 5 volts D.C., for example, appearing at the inverting amplifiers 54. Thus while the magnitude of the signals supplied at the inputs to the opto-isolators 25 may widely vary depending upon the length of the cable 8 and other varying operating conditions, the signal outputs supplied to the signal converter 26 will be maintained at a uniform and stable magnitude under all operating conditions for a reliable operation.

The inverting amplifiers 54 and 55 provide little amplification or gain, if any, and invert the logic of the signal appearing at the collectors 49 of the phototransistor 48. The inverting amplifiers 54 and 55 may utilize one of a plurality of inverting logic amplifiers such as manufactured by Signetics and designated SN7404. The amplifiers 54 and 55 contain circuits which are connected to and operate with respect to the logic circuit common provided at lead 53.

In operation, an input signal appearing at the lead M-12 and supplied to the channel 34 will render the phototransistor 48 conductive to operably connect the collector circuit 49 to the logic circuit ground lead 53 thereby effectively providing a logic circuit ground potential input to the inverter 54 which, in turn, provides a logic 1 signal to the output lead M-14 while the inverter 55 provides a logic 0 signal to the output lead M-13.

Figure 5:
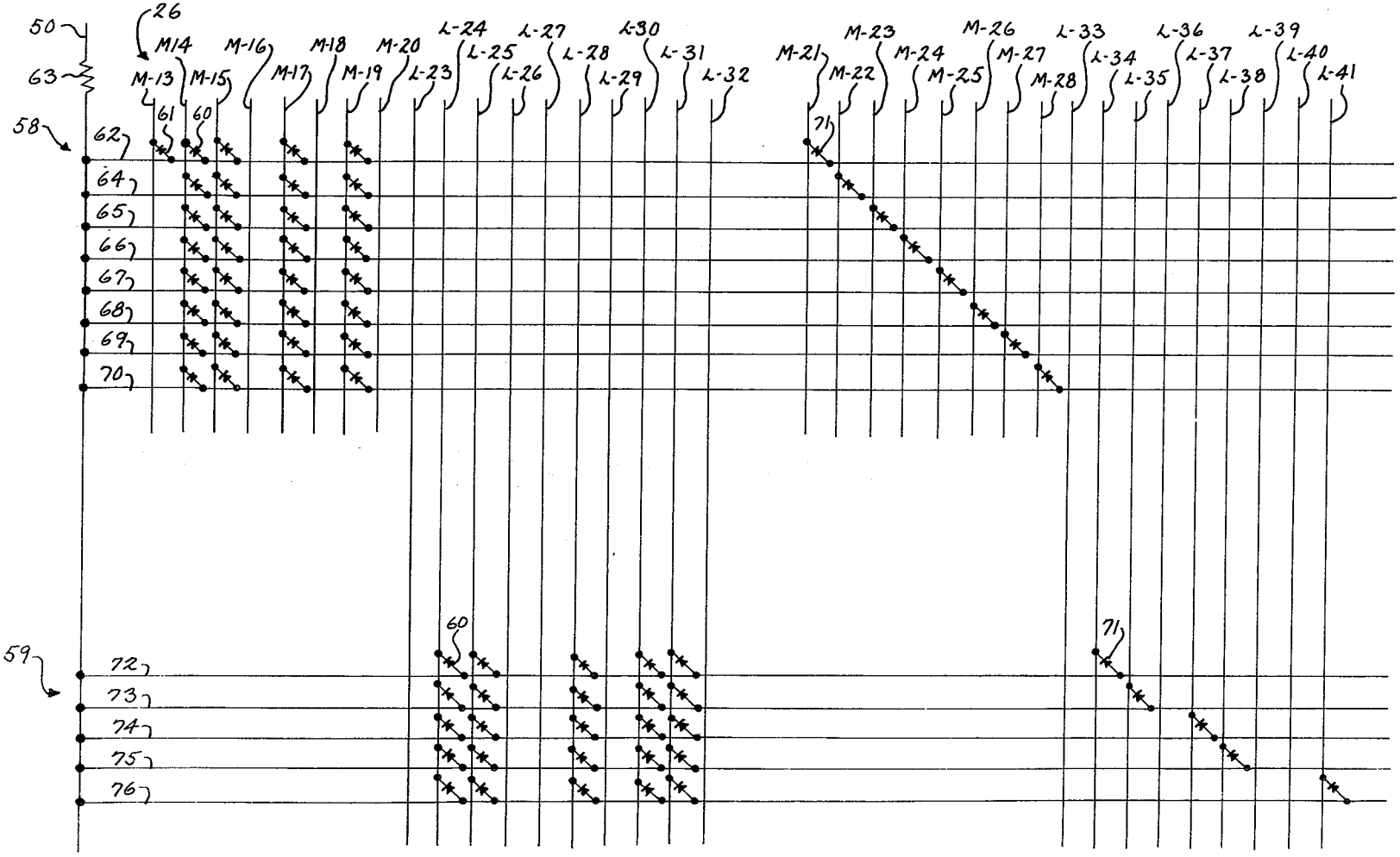
FIG. 5 is a circuit schematic showing a portion of the circuitry within the signal converter of the display module shown in FIG. 4.

The signal converter 26 is partially shown in FIG. 5 and includes a logic portion 58 utilized with the signals for displaying the letter B in the left hand character display and another logic portion 59 utilized with the signals for displaying the letter M in the right hand character display.

The signal converter 26 employs a programmable logic array such as manufactured by the Microelectronic Device Division of the Rockwell International Corporation and designated SOS/LSI, P/N15900NB which utilizes a silicon-on-sapphire technology to provide a miniaturized logic array providing 5,888 permanently encodable diodes organized into 128 rows and forty six columns. Applicants employ eighteen input columns designated M-13 through M-20 and L-23 through L-32 together with seventeen output columns designated M-21 through M-28 and L-33 through L-41 which are specially interconnected through one or more of the rows and interconnecting diodes. Applicants' preferred embodiment employs 123 rows of the total possible 128 rows provided by the Rockwell programmable logic array and 35 of the total possible 46 columns. The logic array 26 is specially pre-programmed from a manufactured array which interconnects each colummn and row by an interconnecting diode such as at 60 by selectively removing the unwanted diodes with a laser encoder, such as illustrated at 61. As an example, a row 62 which is connected to the positive D.C. voltage lead 50 through a resistor 63 is disconnected from the input lead M-13 by the selective removal of the diode at location 61 and connected to the input lead M-14 through the diode 60. In like manner, the rows at 64 through 70 are likewise connected to the input lead M-14 through similarly situated diodes 60. It is further observed that the rows 62 and 64 through 70 are likewise connected through similarly situated diodes 60 to the input leads M-15, M-17 and M-19. It is further observed that the row 62 is connected to the output lead M-21 through a diode such as at 71 while the rows 64 through 70, inclusive, are connected to the output leads M-22 through M-28, respectively, through similarly situated diodes 71 in a like manner.

The logic circuit 59 includes the rows 72 through 76 which are each connected to the input leads L-24, L-25, L-28, L-30 and L-31 through the diodes 60 while the column 72 is connected to the 54 lead L-34, the row 73 connected to the output lead L-35, the row 74 connected to the output lead L-37, the row 75 connected to the output lead L-38 and the row 76 connected to the output lead L-41 through the diodes 71. L-24, L-28

The logic truth table encompassing the input/output code combinations for the signal converter 26 is illustrated as follows:

Left Character

| Character | Inputs M12 | M11 | M10 | M9 | Outputs M21 | M22 | M23 | M24 | M25 | M26 | M27 | M28 |
|---|---|---|---|---|---|---|---|---|---|---|---|---|
| Blank | 0 | 0 | 0 | 0 | 0 | 0 | 0 | 0 | 0 | 0 | 0 | 0 |
| 1 | 0 | 0 | 0 | 1 | 0 | 1 | 1 | 0 | 0 | 0 | 0 | 0 |
| 2 | 0 | 0 | 1 | 0 | 1 | 1 | 0 | 1 | 1 | 0 | 1 | 0 |
| 3 | 0 | 0 | 1 | 1 | 1 | 1 | 1 | 1 | 0 | 0 | 1 | 0 |
| 4 | 0 | 1 | 0 | 0 | 0 | 1 | 1 | 0 | 0 | 1 | 1 | 0 |
| 5 | 0 | 1 | 0 | 1 | 1 | 0 | 1 | 1 | 0 | 1 | 1 | 0 |
| B | 1 | 0 | 0 | 0 | 1 | 1 | 1 | 1 | 1 | 1 | 1 | 1 |
| G | 1 | 0 | 1 | 0 | 1 | 0 | 1 | 1 | 1 | 1 | 0 | 0 |
| L | 1 | 1 | 0 | 0 | 0 | 0 | 0 | 1 | 1 | 1 | 0 | 0 |

Right Character

| Character | Inputs L22 | L21 | L20 | L19 | L18 | Outputs L33 | L34 | L35 | L36 | L37 | L38 | L39 | L40 | L41 |
|---|---|---|---|---|---|---|---|---|---|---|---|---|---|---|
| Blank | 0 | 0 | 0 | 0 | 0 | 0 | 0 | 0 | 0 | 0 | 0 | 0 | 0 | 0 |
| 1 | 0 | 0 | 0 | 0 | 1 | 0 | 1 | 1 | 0 | 0 | 0 | 0 | 0 | 0 |
| 2 | 0 | 0 | 0 | 1 | 0 | 1 | 1 | 0 | 1 | 1 | 0 | 1 | 0 | 0 |
| 3 | 0 | 0 | 0 | 1 | 1 | 1 | 1 | 1 | 1 | 0 | 0 | 1 | 0 | 0 |
| 4 | 0 | 0 | 1 | 0 | 0 | 0 | 1 | 1 | 0 | 0 | 1 | 1 | 0 | 0 |
| 5 | 0 | 0 | 1 | 0 | 1 | 1 | 0 | 1 | 1 | 0 | 1 | 1 | 0 | 0 |
| 6 | 0 | 0 | 1 | 1 | 0 | 0 | 0 | 1 | 1 | 1 | 1 | 1 | 0 | 0 |
| 7 | 0 | 0 | 1 | 1 | 1 | 1 | 1 | 1 | 0 | 0 | 0 | 0 | 0 | 0 |
| 8 | 0 | 1 | 0 | 0 | 0 | 1 | 1 | 1 | 1 | 1 | 1 | 1 | 0 | 0 |
| 9 | 0 | 1 | 0 | 0 | 1 | 1 | 1 | 1 | 0 | 0 | 1 | 1 | 0 | 0 |
| 0 | 0 | 1 | 0 | 1 | 0 | 1 | 1 | 1 | 1 | 1 | 1 | 0 | 0 | 0 |
| A | 1 | 1 | 0 | 0 | 0 | 1 | 1 | 1 | 0 | 1 | 1 | 1 | 0 | 0 |
| B | 1 | 0 | 0 | 0 | 0 | 1 | 1 | 1 | 1 | 1 | 1 | 1 | 1 | 0 |
| G | 1 | 0 | 0 | 1 | 0 | 1 | 0 | 1 | 1 | 1 | 1 | 0 | 0 | 0 |
| L | 1 | 0 | 1 | 0 | 0 | 0 | 0 | 0 | 1 | 1 | 1 | 0 | 0 | 0 |
| M | 1 | 0 | 1 | 1 | 0 | 0 | 1 | 1 | 0 | 1 | 1 | 0 | 0 | 1 |
| P | 1 | 0 | 0 | 0 | 1 | 1 | 1 | 0 | 0 | 1 | 1 | 1 | 0 | 0 |
| S | 1 | 0 | 1 | 0 | 1 | 1 | 0 | 1 | 1 | 0 | 1 | 1 | 0 | 0 |

With reference to FIG. 4, the outputs M-21 through M-28 and L-33 through L-41 supplied from the signal converter 26 are each coupled to a driver stage such as at 77 which provides an inverting amplifying circuit for driving the position display 10. Each of the inverting amplifiers 77 could desirably utilize a hex inverter designated as SP391A supplied by Signetics having an open collector output. As illustrated in FIG. 4, the eight output leads designated M-21 through M-28 supplied from the signal converter 26 are coupled through the inverting amplifiers 77 to corresponding output leads M-29 through M-36, respectively. In like manner, the nine output leads designated L-33 through L-41 supplied from the signal converter 26 are also connected through the inverting amplifiers 77 to corresponding output leads L-42 through L-50, respectively. The inverting amplifiers 77 each constituting a signal driver contain circuits which are connected to and operate with respect to the logic circuit common provided at the lead 53.

The position display 10 is more fully shown in FIGS. 6 and 7 with the most significant or left hand character represented in FIG. 6 and connected to the eight output leads designated M-29 through M-36 and the least significant or right hand character displayed in FIG. 7 and connected to the nine output leads designated L-42 through L-50. The character displays illustrated in FIGS. 6 and 7 employ a plurality of light emitting diodes specially arranged into groups or segments and are selectively energized to provide any one of a plurality of desired numbers or letters. The inventors have found that the utilization of a light emitting diode as 5082-4488 supplied by Hewlett Packard which provides a gallium arsenide phosphide light emitting diode has provided ideal results in providing distinct illumination even on bright days.

The left character display shown in FIG. 6 includes a first group 78 containing the serially connected light emitting diodes 79, 80 and 81 with the anode of diode 79 connected to the positive D.C. voltage lead 50 and the cathode of diode 81 connected to the input lead M-29. A second group 82 includes the serially connected light emitting diodes 83, 84 and 85 with the anode of diode 85 connected to the positive voltage lead 50 and the cathode of diode 83 connected to the input lead M-35. A third group 86 includes the serially connected light emitting diodes 87, 88 and 89 with the anode of diode 89 connected to the positive voltage lead 50 and the cathode of the diode 87 connected to the input lead M-32. A fourth group 90 includes the serially connected light emitting diodes 91, 92 and 93 with the anode of diode 91 connected to the positive voltage source lead 50 and the cathode of diode 93 connected to the input lead M-30. A fifth group 94 includes the serially connected light emitting diodes 95, 96 and 97 with the anode of diode 95 connected to the positive voltage source lead 50 and the cathode of diode 97 connected to the input lead M-31. A sixth group 98 includes the serially connected light emitting diodes 99, 100 and 101 with the anode of diode 99 connected to the positive voltage source lead 50 and the cathode of diode 101 connected to the input lead M-34. A seventh group 102 includes the serially connected diodes 103, 104 and 105 with the anode of diode 103 connected to the positive voltage source lead 50 and the cathode of diode 105 connected to the input lead M-33. An eighth group 106 includes the serially connected light emitting diodes 107 and 108 with the anode of diode 107 connected to the positive voltage source lead 50 and the cathode of the diode 108 connected to the input lead M-36.

The segment 78 is horizontally positioned in the upper portion of the display, the segment 86 is horizontally positioned in the lower portion of the display and the segment 82 is horizontally positioned in the intermediate portion of the display in FIG. 6. The segment 90 is substantially vertically positioned in the upper right hand portion of the display, the segment 94 is substantially vertically positioned in the lower right hand portion of the display, the segment 98 is substantially horizontally positioned in the upper left hand portion of the display and the segment 102 is substantially vertically positioned in the lower left hand portion of the display. The segment 106 provides diodes in the upper and lower left hand corners of the display which are spaced to the left of the segments 78 and 86 in substantial alignment.

Certain segments and light emitting diodes therein utilized in the right character in FIG. 7 are similarly constructed and positioned as certain segments and diodes above described in FIG. 6 so that similar elements will be identified by identical numbers primed and further description thereof is deemed unnecessary. It is only noted that the segment 78′ is connected to the input L-42, the segment 90′ connected to the input L-43, the segment 94′ connected to the input L-44, the segment 82′ connected to the input L-48, the segment 86′ connected to the input L-45, the segment 98′ connected to the input L-47, the segment 102′ connected to the input L-46 and the segment 106′ connected to the input L-49.

The character display in FIG. 7 further includes a ninth group 109 containing the serially connected diodes 110, 111 and 112 with the anode of diode 110 connected to the positive voltage lead 50 and the cathode of diode 112 connected to the input lead L-50. The three diodes within the segment 109 are positioned to form a V or wedge shape and are spaced within an opening between the groups 78′, 82′, 90′ and 98′.

In order to provide an example to clearly illustrate the operation of the highly novel elevator position signaling system, it will be assumed that the car position monitor 21 operates to energize the input leads M-6 and L-16 and provide the letter B for the left character in FIG. 6 and the letter M for the right character in FIG. 7 to hypothetically designate a "basement mezzanine" if such designation were appropriate. The energization of the input lead M-6 provides an output at M-12 while the energization of the input lead L-16 provides output signals at L-19, L-20 and L-22 so that only four leads within the cable 8 will be conducting a coded signal to the vehicle module 24.

The control signal at M-12 is supplied to channel 34 of the opto-isolator 25 and renders the phototransistor 48 conductive to operatively connect the input of the inverter 54 to the logic ground 53. The inverter 34 operates to provide a logic 1 to the output lead M-14 and a logic 0 to the output lead M-13. The control signals at L-22, L-20 and L-29 are supplied to the channels 38, 40 and 41, respectively, so that logic 1 signals appear at the output leads L-24, and L-30 while logic 0 signals appear at the output leads L-23, L-27 and L-29 in a similar manner.

The logic 1 or positive voltage signal appearing at the output terminal M-14 back biases the diodes 60 within the column designated as M-14 within the signal converter 26 while the logic 1 signals normally appearing at the terminals M-15, M-17 and M-19 likewise back-bias the diodes 60 in the respective columns. A current signal supplied from the rows 62 and 64 through 70 may not pass through the diodes 60 to the input leads M-14, M-15, M-17 and M-19 because of the back biasing thereof but rather is supplied to the output leads M-21 through M-28, inclusive, through the connecting diodes 71. The logic circuitry 59 operates in a like manner in that positive logic 1 signals appearing at the input columns L-24, L-28 and L-30 in response to the signals appearing at L-22, L-20 and L-19 together with the logic 1 signals normally appearing at the terminals L-25 and L-31 back biasing the corresponding diodes 60 so that the current signals supplied through the rows 72 through 76 are conducted through the diodes 71 to provide output signals at the leads L-34, L-35, L-37, L-38 and L-41.

The positive logic 1 signals appearing at the output leads M-21 through M-28, inclusive, are inverted by the corresponding inventing amplifiers 77 to provide a grounded or logic 0 output at the leads M-29 through M-36. As can be readily visualized by viewing FIG. 6, the logic 0 or grounded connection at the leads M-29 through M-36, inclusive, provide a current conducting path from the positive voltage source lead 50 through the segments 78, 82, 86, 90, 94, 98, 102 and 106 so that all of the light emitting diodes within FIG. 6 are energized to clearly display the letter B as illustrated in FIG. 8.

The logic 1 signals at the output leads L-34, L-35, L-37, L-38 and L-41 of the signal converter 26 are supplied to the inverting amplifiers 77 which, in turn, supply logic 0 or grounded outputs at the corresponding output leads L-43, L-44, L-46, L-47 and L-50. Thus with reference to FIG. 7, current conducting paths are provided from the positive voltage lead 50 through the segment 90′ and the input lead L-43, through the segment 94′ and the input lead L-44, through the segment 102′ and the input lead L-46, through the segment 98′ and the input lead L-47, and through the segment 109′ and the input lead L-50. Such a selective energization of the segments in FIG. 7 provides a highly distinctive letter M as illustrated in FIG. 9.

FIG. 10 further provides an illustrative example of the selective energization of the character display of FIG. 7 in response to the energization of the input lead L-2 by the car position monitor 21 when the car 2 arrives at or near the second floor landing. It is noted that the segments 78′, 82′, 86′, 90′ and 102′ become energized to provide a highly distinctive display representing the second floor location of the car 2.

A plurality of combinations of the two characters in FIGS. 6 and 7 can thus be provided in response to the selective energization of the 25 leads M-1 through M-8 and L-1 through L-17 by the floor position monitor 21. The traveling cable 8 in the preferred embodiment includes the nine coded signaling leads M-9 through M-12 and L-18 through L-22, the machine room ground lead 19 and the two directional signal leads 28 and 29. It is understood that the power leads 30 and 31 could be associated with the cable 8 if desired.

The controller 7 also functions to sense the commanded direction of car 2 and selectively close the up direction contacts SUA-1 or the down direction contacts SDA-1 to provide a proper direction indication within the display 9.

A highly compact and easily serviceable vehicle module 24 and lobby module 33 is provided by the fact that each module provides three printed circuit boards with one board including the direction display 9, another board containing the position display 10 and the third board containing the isolating, converting and driving assembly 23.

The opto-isolators 25 desirably transfers the electrical system in the modules 24 and 33 from a machine room ground reference to a logic circuit ground reference for providing a uniform and reliable isolated output to the signal converter 26 and the display drivers 27 for driving the position display 10. The opto-isolators 25 thus eliminate potential malfunctions due to noise and other transient signals such as may be induced within the leads in the traveling cable 8 or when the vehicle car door has been operated.

A highly desirable signal converter 26 is provided including a miniaturized diode matrix which can be readily pre-programmed in accordance with applicants novel code as previously described.

FIG. 11 represents an alternative character display embodiment for optional use in the position display 10 which includes a plurality of segments each including a plurality of light emitting diodes elliptically formed to provide a script type font. Such elliptical segments are selectively energized to provide a wide variety of numbers and letters in a very attractive script type character presentation. Specifically, the alternative display in FIG. 11 includes an upper portion 113 and a lower portion 114 each containing five elliptically shaped segments. The upper portion 113 includes a substantially vertical segment 115 having an upper end portion 116 and a lower end portion 117. A second segment 118 includes a first end portion 119 located adjacent to end 116 and a second end portion 120. A third segment 121 includes a first end portion 122 located adjacent to end 117 and a second end portion 123 located adjacent to end 120. A fourth segment 124 includes a first end portion 125 located adjacent to ends 116 and 119 and a second end portion 126. A fifth segment 127 includes a first end portion 128 located adjacent to ends 117 and 122 and a second end portion 129 located adjacent to end 126. The segments 118, 121, 124 and 127 are formed in an egg-shape while the segment 115 dissects the egg-shaped design.

The lower portion 114 includes a sixth segment 130 having an upper end portion 131 located adjacent to the end 117 and a lower end portion 132. A seventh segment 133 includes a first end portion 134 located adjacent to ends 131 and 122 and a second end portion 135. An eighth segment 136 includes a first end portion 137 located adjacent to end 132 and a second end portion 138 located adjacent to end 135. A ninth segment 139 includes a first end portion 140 located adjacent to ends 131 and 128 and a second end portion 141. A tenth segment 142 includes a first end portion 143 located adjacent to ends 132 and 137 and a second end portion 144 located adjacent to ends 141.

The logic coding within the signal converter 22 and within the circuitry 23 can be readily modified in accordance with the teachings of the preferred embodiment as above described to form a plurality of script type numbers and letters. As an example, the alternative display in FIG. 11 may be energized to display the number three as illustrated in FIG. 12 by the selective energization of the elliptical segments 115, 124, 133 and 136. A lower case script *g* is displayed in FIG. 13 by the selective energization of the elliptical segments 115, 121, 124, 127, 130, 134 and 142. An upper case script T is displayed in FIG. 14 by the selective energization of the elliptical segments 115, 118, 124 and 130. The alternative display in FIG. 11 can, in fact, be selectively energized to selectively provide the numbers 0 through 9, inclusive, and a wide variety of upper and lower case letters.

A highly desirable and novel grouping of light emitting diodes is provided forming segments which are selectively energized to provide preselected character visual presentations to indicate the position of the elevator car to passengers within the car and possibly to perspective passengers waiting in the lobby or at the various landings. The highly novel two character position display employing eight and nine segments containing light emitting diodes in the preferred embodiment provides greater flexibility in presenting a larger number of letters together with the customary floor numbers as illustrated in FIGS. 8 through 10. In addition, the novel script type characters employing 10 elliptical segments offers a versatile signaling system. While the preferred embodiment of the invention includes a highly novel elevator signaling system, the invention could provide a signaling system for restaurants, industrial process, or the like.

Various modes of carrying out the invention are contemplated as being within the scope of the following claims particularly pointing out and distinctly claiming the subject matter which is regarded as the invention.

We claim:

1. An elevator system connected to a structure having a plurality of floors and comprising an elevator car, means mounting said car for movement relative to the structure to serve said floors, and control means moving said car and stopping said car at floors and including means sensing the relative position of said car with respect to said floors and connected to position indicating means remotely located with respect to said sensing means and selectively displaying at least one of a plurality of characters and indicating the position of said car with respect to said floors, said position indicating means including a plurality of light emitting segments including first, second and third substantially horizontal segments vertically spaced with respect to each other and each including first and second spaced end portions, a fourth substantially vertical segment located adjacent to said second ends of said first and second segments, a fifth substantially vertical segment located adjacent to said second ends of said second and third segments, a sixth substantially vertical segment located adjacent to said first ends of said first and second segments, a seventh substantially vertical segment located adjacent to said first ends of said second and third segments, and an eighth segment having first and second portions with said first portion located adjacent to and in substantial horizontal alignment with said first end of said first segment and located adjacent to said sixth segment and said second portion located adjacent to and in substantial horizontal alignment with said first end of said third segment and located adjacent to said seventh segment, said control means including means operatively connected to said sensing means and selectively energizing one or more of said segments to selectively display a character selected from said plurality of characters including the numbers 0–9 and the letter B for indicating the position of said elevator car.

2. The elevator system of claim 1, wherein said plurality of segments include a ninth V-shaped segment having first and second upper end portions and an intermediate portion with said first portion located adjacent to said sixth segment and said second portion located adjacent to said fourth segment, said plurality of segments responding to said energizing means to selectively display the letter M.

3. The elevator system of claim 1, wherein said first and second portions of said eighth segment each includes a light emitting diode.

4. The elevator system of claim 1, wherein said first through seventh segments inclusive, each includes three serially connected light emitting diodes forming an elongated segment.

5. The elevator system of claim 1, wherein said plurality of segments are operatively connected to said sensing means by light sensitive circuit isolating means.

6. An elevator system connected to a structure having a plurality of floors and comprising an elevator car, means mounting said car for movement relative to the structure to serve said floors, and control means moving said car and stopping said car at floors and including means sensing the relative position of said car with respect to said floors and connected to position indicating means remotely located with respect to said sensing means and selectively displaying at least one of a plurality of characters and indicating the position of said car with respect to said floors, said position indicating means including a plurality of light emitting segments including first, second and third substantially horizontal segments vertically spaced with respect to each other and each including first and second spaced end portions, a fourth substantially vertical segment located adjacent to said second ends of said first and second segments, a fifth substantially vertical segment located adjacent to said second ends of said second and third segments, a sixth substantially vertical segment located adjacent to said first ends of said first and second segments, a seventh substantially vertical segment located adjacent to said first ends of said second and third segments, and an eighth V-shaped segment having first and second upper end portions and an intermediate portion with said first portion located adjacent to said sixth segment and said second portion located adjacent to said fourth segment, said control means including means operatively connected to said sensing means and selectively energizing one or more of said segments to selectively display a character selected from said plurality of characters including the numbers 0–9 and the letter M for indicating the position of said elevator car.

7. The elevator system of claim 6, wherein said first and second upper end portions and said intermediate portion of said eighth segment each include a light emitting diode.

8. The elevator system of claim 6, wherein said first through seventh segments inclusive, each includes three serially connected light emitting diodes forming an elongated segment.

9. The elevator system of claim 6, wherein said plurality of segments are operatively connected to said sensing means by light sensitive circuit isolating means.

10. An elevator system connected to a structure having a plurality of floors and comprising an elevator car, means mounting said car for movement relative to the structure to serve said floors, and control means moving said car and stopping said car at floors and including means sensing the relative position of said car with respect to said floors and connected to position indicating means selectively displaying at least one character indicating the position of said car with respect to said floors, said indicating means including seven elongated segments arranged to be selectively energized in response to the operation of said sensing means to form numerical characters selected from the numbers 0–9 and an eighth segment located in combination with one or more of said seven segments and selectively energized in response to the operation of said sensing means to form an alpha character selected from a plurality of alpha characters including the letter B.

11. An elevator system connected to a structure having a plurality of floors and comprising an elevator car, means mounting said car for movement relative to the structure to serve said floors, and control means moving said car and stopping said car at floors and including means sensing the relative position of said car with respect to said floors and connected to position indicating means and selectively displaying at least one character indicating the position of said car with respect to said floors, said indicating means including seven elongated segments arranged to be selectively energized in response to the operation of said sensing means to form numerical characters selected from the numbers 0–9 and an eighth segment located in combination with one or more of said seven segments and selectively energized in response to the operation of said sensing means to form an alpha character selected from a plurality of alpha characters including the letter M.

12. An elevator system connected to a structure having a plurality of floors and comprising an elevator car, means mounting said car for movement relative to the structure to serve said floors, and control means moving said car and stopping said car at floors and including means sensing the relative position of said car with respect to said floors and position indicating means remotely located with respect to said sensing means and selectively displaying at least one character indicating the position of said car with respect to said floors, said control means including coupling means electrically connecting said sensing means and said indicating means and providing a first plurality of first coded control signals in response to the operation of said sensing means, said indicating means including means operatively receiving said first control signals and providing a second plurality of control signals electrically isolated from and related to said first plurality of signals and means responding to said second control signals and providing a third plurality of control signals having a second code differing from said first code and selectively energizing a plurality of light emitting means displaying said position character.

13. An elevator system connected to a structure having a plurality of floors and comprising an elevator car, means mounting said car for movement relative to the structure to serve said floors, and control means moving said car and stopping said car at floors and including means sensing the relative position of said car with respect to said floors and position indicating means remotely located with respect to said sensing means and selectively displaying at least one character indicating the position of said car with respect to said floors, said control means including coupling means electrically connecting said sensing means and said indicating means and providing a first plurality of control signals in response to the operation of said sensing means, said indicating means including converting means providing a light sensitive circuit isolating means connected to operatively receive said first control signals and provide a second plurality of control signals electrically isolated from and related to said first plurality of signals, said indicating means including a plurality of light emitting means operatively connected to said converting means and selectively energized in response to said second plurality of signals to display said position character.

14. An elevator system connected to a structure having a plurality of floors and comprising an elevator car, means mounting said car for movement relative to the structure to serve said floors, and control means moving said car and stopping said car at floors and including means sensing the relative position of said car with respect to said floors and position indicating means remotely located with respect to said sensing means and selectively displaying at least one character indicating the position of said car with respect to said floors, said control means including coupling means electrically connecting said sensing means and said indicating means and providing a first plurality of control signals in response to the operation of said sensing means and including a first reference signal relating to the reference potential of said sensing means, said indicating means including converting means connected to operatively receive said first control signals and provide a second plurality of control signals electrically isolated from and related to said first plurality of signals and including a second reference signal isolated from said first reference signal, said indicating means including a plurality of light emitting means operatively connected to said converting means and selectively energized in response to said second plurality of signals to display said position character with said second reference signal establishing a reference potential for said plurality of light emitting means.

15. An elevator system connected to a structure having a plurality of floors and comprising an elevator car, means mounting said car for movement relative to the structure to serve said floors, and control means moving said car and stopping said car at floors and including means sensing the relative position of said car with respect to said floors and position indicating means remotely located with respect to said sensing means and selectively displaying at least one of a plurality of alpha numerical characters and indicating the position of said car with respect to said floors, said sensing means including a car position means providing a first predetermined number of inputs each corresponding to a predetermined floor and connected to a first signal converting means providing a second predetermined number of coded outputs less than said first predetermined number in response to a position signal appearing at one of said first inputs corresponding to the floor where said car is located, said position indicating means including opto-isolating means connected to said second outputs and providing a third predetermined number of outputs in response to and electrically isolated from said second outputs and connected to a second signal converting means providing a fourth predetermined number of coded outputs responsive to said third outputs and connected to a multiple segment display through driver means operatively connecting one or more of said segments in circuit for energization to selectively display a character in response to said position signal.

16. An elevator system connected to a structure having a plurality of floors and comprising an elevator car, means mounting said car for movement relative to the structure to serve said floors, and control means moving said car and stopping said car at floors and including means sensing the relative position of said car with respect to said floors and connected to position indicating means remotely located with respect to said sensing means and selectively displaying at least one character indicating the position of said car with respect to said floors, said indicating means including means operatively receiving a first plurality of first coded control signals from said sensing means and providing a second plurality of control signals electrically isolated from said first signals and in response thereto and means responding to said second control signals and providing a third plurality of control signals having a second code differing from said first code and selectively energizing a plurality of elongated segments arranged to selectively form predetermined script type alpha numerical characters in response to the operation of said sensing means.

17. An elevator system connected to a structure having a plurality of floors and comprising an elevator car, means mounting said car for movement relative to the structure to serve said floors, and control means moving said car and stopping said car at floors and including means sensing the relative position of said car with respect to said floors and connected to position indicating means remotely located with respect to said sensing means and selectively displaying at least one character indicating the position of said car with respect to said floors, said indicating means including a plurality of elongated segments each including a plurality of elliptically formed light emitting diodes arranged to be selectively energized in response to the operation of said sensing means to selectively form predetermined script type alpha numerical characters in response to the operation of said sensing means.

18. An elevator system connected to a structure having a plurality of floors and comprising an elevator car, means mounting said car for movement relative to the structure to serve said floors, and control means moving said car and stopping said car at floors and including means sensing the relative position of said car with respect to said floors and connected to position indicating means remotely located with respect to said sensing means and selectively displaying at least one character indicating the position of said car with respect to said floors, said indicating means including a plurality of elongated segments arranged to form an upper section spaced above a lower section with said upper section including a first substantially vertical elliptical segment having first and second ends, a second elliptical segment having a first end located adjacent to said first end of said first segment, a third elliptical segment having a first end located adjacent to said second end of said first segment and a second end located adjacent to a second end of said second segment, a fourth elliptical segment having a first end located adjacent to said first ends of said first and second segments, a fifth elliptical segment having a first end located adjacent said second end of said first segment and said first end of said third segment and a second end located adjacent to a second end of said fourth segment, said lower section including a sixth substantially vertical elliptical segment having a first end located adjacent said second end of said first segment, a seventh elliptical segment having a first end located adjacent to said first end of said sixth segment, an eighth elliptical segment having a first end located adjacent to a second end of said sixth segment and a second end located adjacent to a second end of said seventh segment, a ninth elliptical segment having a first end located adjacent to said first ends of said sixth and seventh segments, and a tenth elliptical segment having a first end located adjacent said second end of said sixth segment and said first end of said eighth segment and a second end located adjacent to a second end of said ninth segment, said segments selectively energized in response to the operation of said sensing means to selectively form predetermined script type alpha numerical characters in response to the operation of said sensing means.

19. A signaling system comprising means operable in response to the selective actuation of a predetermined number of inputs and providing a predetermined number of outputs, and indicating means connected to said output means and selectively displaying a character indicating the selective actuation of said inputs and including seven elongated segments arranged to be selectively energized in response to the actuation of said inputs to form numerical characters selected from the numbers 0–9 and an eighth segment located in combination with one or more of said seven segments and selectively energized in response to the actuation of said inputs to form an alpha character selected from a plurality of alpha characters including the letter B.

20. The signaling system of claim 19, wherein said seven segments includes first, second and third substantially horizontal segments vertically spaced with respect to each other and each including first and second spaced end portions, a fourth substantially vertical segment located adjacent to said second ends of said first and second segments, fifth substantially vertical segment located adjacent to said second ends of said second and third segments, a sixth substantially vertical segment located adjacent to said first ends of said first and second segments, a seventh substantially vertical segment located adjacent to said first ends of said second and third segments, and said eighth segment having first and second portions with said first portion located adjacent to and in substantial horizontal alignment with said first end of said first segment and located adjacent to said sixth segment and said second portion located adjacent to and in substantial horizontal alignment with said first end of said third segment and located adjacent to said seventh segment.

21. The signaling system of claim 20, wherein said plurality of segments includes a ninth V-shaped segment having first and second upper end portions and an intermediate portion with said first portion located adjacent to said sixth segment and said second portion located adjacent to said fourth segment, said plurality of segments responding to said output means to selectively display the letter M.

22. The signaling system of claim 21, wherein said first and second portions of said eighth segment each includes a light emitting diode, said first through seventh segments inclusive each includes three serially connected light emitting diodes forming an elongated segment, and said first and second upper end portions and said intermediate portion of said ninth segment each include a light emitting diode.

23. A signaling system comprising means operable in response to the selective actuation of a predetermined number of inputs and providing a predetermined number of outputs, and indicating means selectively displaying a character indicating the selective actuation of said inputs and including seven elongated segments arranged to be selectively energized in response to the actuation of said inputs to form numerical characters selected from the numbers 0–9 and an eighth segment located in combination with one or more of said seven segments and selectively energized in response to the actuation of said inputs to form an alpha character selected from a plurality of alpha characters including the letter M.

24. The signaling system of claim 23, wherein said seven segments includes first, second and third substantially horizontal segments vertically spaced with respect to each other and each including first and second spaced end portions, a fourth substantially vertical segment located adjacent to said second ends of said first and second segments, a fifth substantially vertical segment located adjacent to said second ends of said second and third segments, a sixth substantially vertical segment located adjacent to said first ends of said first and second segments, a seventh substantially vertical segment located adjacent to said first ends of said second and third segments, and said eighth segment having a V-shape with first and second upper end portions and an intermediate portion with said first portion located adjacent to said sixth segment and said second portion located adjacent to said fourth segment.

25. A signaling system comprising means operable in response to the selective actuation of a predetermined number of inputs and providing a predetermined number of outputs, indicating means remotely located with respect to said output means and selectively displaying a character indicating the selective actuation of said inputs, and coupling means connecting said output means and said indicating means and providing a first plurality of first coded control signals in response to said outputs, said indicating means including means operatively receiving said first control signals and providing a second plurality of control signals electrically isolated from and related to said first plurality of signals and means responding to said second control signals and providing a third plurality of control signals having a second code differing from said first code and selectively energizing a plurality of light emitting means displaying said character.

26. A signaling system comprising means operable in response to the selective actuation of a predetermined number of inputs and providing a predetermined number of outputs, indicating means remotely located with respect to said output means and selectively displaying a character indicating the selective actuation of said inputs, and coupling means connecting said output means and said indicating means and providing a first plurality of control signals in response to said outputs, said indicating means including converting means operatively receiving said first control signals and providing a second plurality of control signals electrically isolated from and related to said first plurality of signals, said indicating means including a light sensitive circuit isolating means and a plurality of light emitting means operatively connected to said converting means and selectively energized in response to said second plurality of signals to display said character.

27. A signaling system comprising means operable in response to the selective actuation of a predetermined number of inputs and providing a predetermined number of outputs, indicating means remotely located with respect to said output means and selectively displaying a character indicating the selective actuation of said inputs, and coupling means connecting said output means and said indicating means and providing a first plurality of control signals in response to said outputs and including a first reference signal relating to the reference potential of said output means, said indicating means including converting means operatively receiving said first control signals and providing a second plurality of control signals electrically isolated from and related to said first plurality of signals and including a second reference signal isolated from said first reference signal, said indicating means including a plurality of light emitting means operatively connected to said converting means and selectively energized in response to said second plurality of signals to display said character with said second reference signal establishing a reference potential for said plurality of light emitting means.

28. A signaling system comprising means operable in response to the selective actuation of a first predetermined number of inputs and providing a second predetermined number of coded outputs less than said first predetermined number in response to a signal provided by one of said inputs, and indicating means remotely located with respect to said output means and selectively displaying at least one of a plurality of alpha numerical characters and indicating the actuation of said inputs and including opto-isolating means connected to said second coded outputs and providing a third predetermined number of outputs in response to and electrically isolated from said second coded outputs and connected to signal converting means providing a fourth predetermined number of coded outputs responsive to said third outputs and connected to a multiple segment display through driver means operatively connecting one or more of said segments in circuit for energization to selectively display a character in response to said input signal.

* * * * *

UNITED STATES PATENT AND TRADEMARK OFFICE

CERTIFICATE OF CORRECTION

PATENT NO. : 3,967,700

DATED : July 6, 1976

INVENTOR(S) : Charles J. Tur and Donald J. Kopydlowski

It is certified that error appears in the above-identified patent and that said Letters Patent are hereby corrected as shown below:

| | |
|---|---|
| Column 8, Line 10, | Cancel "M-16" and substitute therefor ---M-11.---; |
| Column 8, Line 11, | Cancel "supplied"; |
| Column 12, Line 22, | Cancel "54" and substitute therefor ---output---; |
| Column 12, Line 27, | Cancel "L-24, L-28"; |
| Column 14, Line 52, | Cancel "L-29" and substitute therefor ---L-19---; |
| Column 14, Line 54, | After "L-24," insert ---L-28---; |
| Column 22, Line 26, CLAIM 20 | After "segments," insert ---a---. |

Signed and Sealed this

First Day of February 1977

[SEAL]

*Attest:*

RUTH C. MASON
*Attesting Officer*

C. MARSHALL DANN
*Commissioner of Patents and Trademarks*